US005511665A

United States Patent [19]

Dressel et al.

[11] Patent Number: 5,511,665

[45] Date of Patent: Apr. 30, 1996

[54] CHILD-RESISTANT PACKAGE

[75] Inventors: Mark W. Dressel, Lake Zurich; John M. Bitner, Aurora, both of Ill.

[73] Assignee: G. D. Searle & Co., Chicago, Ill.

[21] Appl. No.: 331,757

[22] Filed: Oct. 31, 1994

[51] Int. Cl.[6] ..... B65D 83/04; B65D 27/00

[52] U.S. Cl. ..... 206/532; 206/469; 206/484; 206/534; 229/316

[58] Field of Search ..... 206/532, 534, 206/484, 469; 229/307, 313, 316; 383/207

[56] References Cited

U.S. PATENT DOCUMENTS

| | | | |
|---|---|---|---|
| 2,012,405 | 8/1935 | Salfisberg | 206/532 X |
| 3,809,220 | 5/1974 | Arcudi | 206/484 |
| 4,398,634 | 8/1983 | McClosky | 206/532 |
| 4,567,986 | 2/1986 | Eastwood | 206/532 |
| 5,046,618 | 9/1991 | Wood | 206/532 |
| 5,088,603 | 2/1992 | Kirkpatrick | 206/484 X |
| 5,310,060 | 5/1994 | Bitner et al. . | |

*Primary Examiner*—Bryon P. Gehman

[57] ABSTRACT

A child-resistant package is resistant to being opened by a child because the package challenges the cognitive skills of a child. However, the package can be easily opened by the elderly or the physically impaired. The package includes either one or a plurality of fold lines, and a tear notch extends across only one of the fold lines. The package can be opened by folding along the fold line with the tear notch and then tearing the package along the tear notch. The package may also include a tear strip which extends between the tear notch and the contents of the package. If a child tears the package along the tear strip, the tear notch is removed and the package is disarmed and prevented from being opened.

19 Claims, 1 Drawing Sheet

CHILD-RESISTANT PACKAGE

BACKGROUND OF THE INVENTION

The present invention generally relates to novel child-resistant blister packages or pouches for medicaments and non-medicaments.

It is desirable for manufacturers of products to provide packaging for their products which is highly resistant to opening by children, but which, at the same time is relatively easy for elderly and physically impaired persons to open. It is also desirable to provide tamper-evident packages which indicate when a child has attempted to open the package.

One of the problems facing parents today is their responsibility of keeping medications and other dangerous and/or small articles beyond the reach of their young children. Young children do not have the ability to recognize the risk involved in consuming prescribed or over-the-counter medication and other dangerous and/or small articles. Because of this fact, there is an important need for a package from which these items are readily accessible to an adult but are not accessible to a young child.

In past years, a trend in the packaging of medication and other dangerous and/or small articles has been to provide packages which will be safe, even if found by young children. Most developments in the "child-proofing" line have been directed to the improvement in pill bottles. In this regard, safety caps have been devised which require a certain series of pushes and turns in order to open the bottle. However, there has been less development in the area of "childproofed" blister packages or pouches with which this invention is concerned.

Blister or pouch packaging has become popular in recent years, not only for medicaments in capsule, lozenge or pill form, but also for small automotive parts, household articles, and miscellaneous hardware.

Blister packages are generally made up of a first sheet, typically a clear, preformed polyvinyl chloride or polystyrene with flexible bubbles which form separate compartments for one or more pills, and a second rupturable sheet material, such as an aluminum foil or paper sheet, which has been attached to the first sheet. The second sheet is attached to the first sheet by heat-sealing, solvent welding, gluing, or otherwise. The articles contained in the package may be removed from the blister compartment by pressing on the flexible blister which, in turn, forces the tablet against the second sheet, rupturing the second sheet, and ejecting the article.

Pouch-type packages generally include a pair of laminated layers which are heat-sealed around the edges but which are unsealed in a central area which provides a pouch for a pill or other item. If the blister package or pouch contains medicine or any item which should be kept away from young children, it is important to "child proof" such packages by rendering these packages too difficult to open by children too young to realize the potential hazard in doing so. At the same time, the package should be user friendly for adult users of the various articles contained in the packages.

The child-resistant blister packages and pouches of the invention for medicaments and non-medicaments are structurally different from child-resistant packaging described in the art.

SUMMARY OF THE INVENTION

The invention provides a child-resistant package for medicaments and non-medicaments which is resistant to being opened by a young child because the package challenges the cognitive skills of the child. However, the package can be easily opened by elderly or physically impaired persons. The package comprises two layers of tear-resistant material which are sealed together except in a central pouch area which contains the packaged item. The package includes a fold line located within an inordinately wider seal area to assist elderly or handicapped persons to grasp and manipulate the package. A tear notch extends across the fold line. The package can be opened only by folding along the fold line and then tearing the package along the tear notch. If the package is not folded along the fold line, the tear notch will not be exposed. The package also preferably includes a tear strip which extends between the tear notch and the contents of the package. If a child tears the package along the tear strip, the tear notch is removed. The package is thereby disarmed and prevented from being opened. The package may include additional fold lines that do not have a tear notch. If a child folds the package along one of these superfluous fold lines and attempts to tear, there will be no notch to initiate the tear, and the package cannot be opened.

BRIEF DESCRIPTION OF THE DRAWINGS

The invention will be explained in conjunction with illustrative embodiments shown in the accompanying drawing, in which.

DETAILED DESCRIPTION OF THE INVENTION

Figure 1:
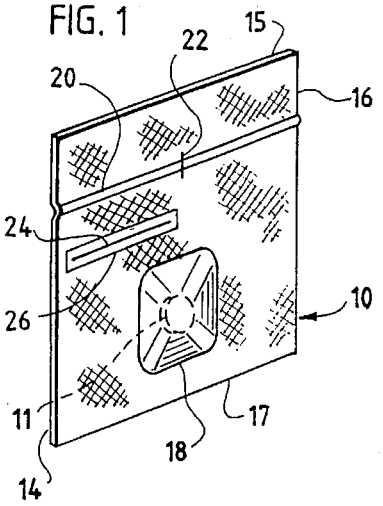
FIG. 1 is a perspective view of a child-resistant package formed in accordance with the invention.

The present invention relates to a novel, child-resistant package for medicaments and non-medicaments which is user-friendly to patients and other users of the package, but which is extremely difficult to open by young children. It is an attractive and inexpensive package for the merchandising of pharmaceutical and other products which is constructed in a manner which facilitates mass production.

The packages of the invention may contain from one to a multiplicity of articles, such as medicaments in the form of capsules, tablets, lozenges, pills and/or the like, or non-medicaments, such as poisons, catalysts, cleaning compositions, batteries, nuts, bolts, hooks and/or other small hardware.

The packages of the invention may be of any convenient size, and of any convenient shape, such as square, rectangular, triangular, round, or oval. The size of the package of the invention will vary, depending upon the number of article-receiving pockets which are contained therein. Preferably, the package of the invention will be of a size ranging from about 12 inches×12 inches to about 1 inch×1 inch, and more preferably about 2 inches×2 inches. The packages of the invention may contain any desired number of article-receiving pockets but preferably contain a single article-receiving pocket.

Specific packages within the scope of the invention include, but are not limited to, the packages discussed in detail herein and/or illustrated in the drawings contained herein.

Contemplated equivalents of the packages described herein and/or illustrated in the drawings contained herein include packages which otherwise correspond thereto, and which have the same general properties and/or components thereof, wherein one or more simple variations of components are made.

The novel child-resistant packages described herein comply with standards of the Poison Prevention Packaging Act of 1970, 15 USC §1471–1475, and with the Act's associated regulations, 16 CFR §1700.1–1700.20, which describe test procedures in which packages are given to children for a given period of time to determine the accessibity to the children of the package contents. These standards have been promulgated by the Consumer Product Safety Commission as standards which reasonably protect children from entering packaging that would contain potentially harmful substances.

"Special Packaging" is defined by the Act and its associated regulations as being packaging that is designed or constructed to be significantly difficult for children under 51 months of age to open, or to obtain a toxic or harmful amount of the substance contained therein, within a reasonable time, and not difficult for normal adults to use properly. However, it does not mean packaging which all such children cannot open, or cannot obtain a toxic or harmful amount of a substance contained therein, within a reasonable time.

The Act and regulations require that special packaging be employed to protect children from serious personal injury or illness resulting from substances such as aspirin, acetaminophen, methyl salicylate, diphenhydramine, controlled drugs, prescription drugs, iron-containing drugs, dietary supplements containing iron, oral contraceptives, sulfuric acid, turpentine, methanol, ethylene glycol, furniture polish, kindling and/or illuminating preparations and solvents for paint and other similar surface-coating materials.

According to the Act and its associated regulations, all special packaging must meet the following specification:

(a) Child-resistant effectiveness of not less than 85 percent without a demonstration, and not less than 80 percent after a demonstration, of the proper means of opening such special packaging. In the case of unit packaging, child-resistant effectiveness of not less than 80 percent. A package in accordance with the invention was formally tested under this protocol and succeeded at 99.5% efficiency.

and (b) Adult-use effectiveness of not less than 90 percent.

Two hundred (200) healthy and normal children between the ages of forty-two (42) and fifty-one (51) months of age, evenly distributed by age and sex, are required by the Act and its associated regulations to be used to test the ability of the special packaging to resist opening by children. A test failure is defined as being any child who opens the special packaging, or who gains access to its contents. In the case of unit packaging, a test failure is defined as being any child who opens, or gains access to, the number of individual units which constitute the amount that may produce serious personal injury or serious illness, or a child who opens, or gains access to, more than eight (8) individual units, whichever number is lower, during the full ten (10) minutes of the testing.

One hundred (100) adults, ages eighteen (18) to forty-five (45) years inclusive, with no overt physical or mental handicaps, and seventy (70) percent of whom are female, must comprise the test panel for normal adults.

The end result of the packages of the invention is that a young child is unlikely to open the packages successfully because, in order to open the packages, one must have knowledge of the opening procedure, rather than merely a minimum amount of strength for opening the package. A young child who is not instructed on the proper opening procedure for the packages of the invention will generally remain unable to reach the contents of the package. An older child who is able to reach the contents of the packages of the invention, on the other hand, should have sufficient understanding and discretion to avoid ingesting the contents of the package. The safety factors presented by such packaging will also tend to protect adults who are too mentally impaired (as by alcohol or drugs) to cope with the task of opening the packages and, at the same time, will allow other adults and even elderly and physically impaired adults to easily open the packages with a minimum amount of strength.

For the purpose of illustrating the packages of the present invention, there are shown in the drawings, which form a material part of this disclosure, two different embodiments of the packages which are presently preferred.

The various components of the packages of the invention are generally arranged in the manner shown in the drawings. However, the present invention is not limited to the precise arrangements, configurations, dimensions and instrumentalities shown in these drawings. These arrangements, configurations, dimensions and instrumentalities may be otherwise, as circumstances require.

Different specific embodiments of the packages of the present invention will now be described with reference to the drawings. The drawings contained herein are provided to enable one of ordinary skill in the art to practice the present invention. These drawings are merely illustrative, however, and should not be read as limiting the scope of the invention as it is claimed in the appended claims.

Referring to the drawings, a child-resistant package 10 of the invention for unit or multiple doses of pharmaceutical products or other articles 11 comprises first and second layers 12 and 13 (FIG. 6) of tear-resistant material. Each of the layers is generally rectangular, and the package includes four side edges 14, 15, 16, and 17. The two layers are sealed together throughout most of their area but are unsealed in a central portion to provide a pouch, pocket, or receptacle 18 for holding the packaged article 11. The package is provided with a fold line, crease, or score line 20 which is spaced inwardly from the side edge and which extends parallel therewith. The fold line can be formed in the package by any conventional procedure.

A tear notch or slit 22 is formed in the layers 12 and 13 and extends across the fold line 20. The tear notch or slit can be formed in any convenient manner, for example, by die cutting the layers 12 and 13 after they are sealed together.

A slit 24 in the layers 12 and 13 extends inwardly from adjacent the side edge 14 generally parallel to fold line 20. The slit 24 is positioned between the tear notch 22 and the pouch 18 but terminates before a line extending from the tear notch to the pouch so that the slit does not interfere with the function of the tear notch as will be described hereinafter. If the tear notch 22 is on the midpoint of the fold line, the slit 24 will extend for less than one-half of the length of the side 15. Preferably, the slit 24 does not extend to the side edge 14 and is spaced from the edge by a short distance, for example, about 2-3 mm so that the side edge is continuous and not interrupted by the slit.

The slit 24 is preferably pre-cut in each of the layers 12 and 13 before the layers are sealed together. A slit can be formed in each of the layers with a rotary die. An unsealed generally rectangular area 26 in each of the layers surrounds the slit so that when the layers are superimposed and sealed, the slits need not be precisely aligned. The unsealed areas 26 allow some tolerance in the alignment of the slits in the two layers so that the package can still be torn along the slits even if the slits are not precisely aligned.

Figure 5:
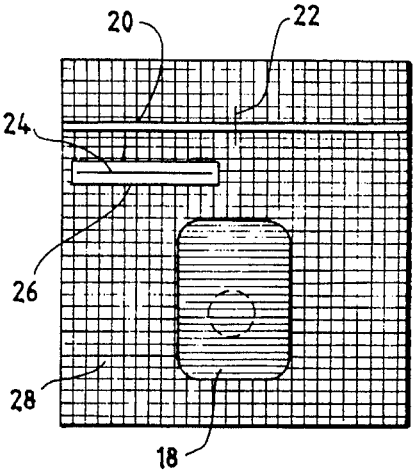
FIG. 5 is a diagramatic view of the package which illustrates the sealed and unsealed areas of the package.

FIG. 5 diagramatically illustrates the sealed and unsealed areas of the package. The main sealed portion 28 of the package is illustrated by the horizontal and vertical cross hatching. The side edges of the layers are sealed so that the layers cannot be peeled apart by grasping loose edges. The fold line 20 is located entirely within the sealed area. The unsealed area 26 is indicated by the non-crosshatched area. The unsealed pouch area 18 is indicated by the horizontal cross hatching.

Figure 2:
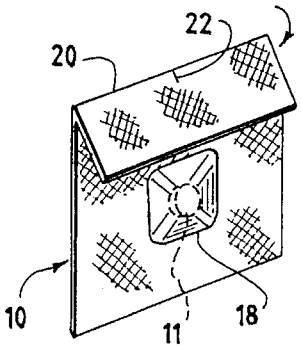
FIG. 2 illustrates the package folded along the fold line to expose a tear notch.
Figure 3:
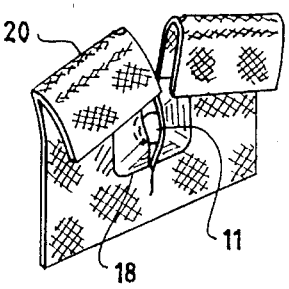
FIG. 3 illustrates the package being torn along the tear notch toward the pouch to expose the contents of the package.

The correct procedure for opening the package is illustrated in FIGS. 2 and 3. The package is folded along the fold line 20 so that the tear slit 22 is exposed on the folded edge. The fold line is located in a wide seal area which extends from the side edge 15 to the pouch 18 and which provides a substantial area to assist elderly and handicapped persons to grasp and manipulate the package. For example, the width of the seal area between the side edge and the pouch may be from about ½ inch to 2 inches or more. The package is grasped by both hands on opposite sides of the slit 22, and the package is then torn along the slit toward the pouch 18 as illustrated in FIG. 3. Once the tear is initiated at the slit 22, the tear can be continued without difficulty through the sealed area which surrounds the pouch 18 to expose the contents of the pouch.

If the package is not folded along the fold line 20, the package cannot be opened because the tear-resistant material of the layers 12 and 13 resists tearing under normal human pull strength unless the edge of the material is slit. If a child does not fold the package along the fold line 20 and cannot open the package, the child may lose interest before folding the package along the fold line. Even if the child folds the package along the fold line, the package can be opened only if the child tears along the tear notch 22, which is difficult for a child to notice.

The slit 24 is also intended to fool the child. If a child tears the package at the slit 24 and continues to tear directionally across the package, the tear notch 22 will be removed from the package. The package will thereby be disarmed and prevented from being opened. If desired, the area of the slit 24 can be imprinted with attractive colors or indicia which increase the likelihood that an inquisitive child will tear the package along the slit 24, thereby disarming the package. Even if the slit 24 does not extend all the way to the side edge 14, the slit is close enough to the edge that a child can initiate a tear without difficulty. Also, once the tear is initiated along the slit 24, the tear can be propagated all the way across the package.

Other types of tear strips can be used. For example, the package can be provided with perforations or a pull string which enable the tear notch 26 to be separated from the package.

The child-resistant package is designed to challenge the cognitive skills of a child. The cognitive strategy not only delays and possibly prevents the child from gaining access to the contents short of scissors but also promotes disarming the package, thereby destroying the capability of ever opening the package. However, the cognitive strategy does not prevent an adult from opening the package. Since the child-resistant features do not rely on manual dexterity or strength, even elderly and physically impaired persons are able to open the package.

The package also provides evidence of tampering. If a package is folded along the fold line, or if the slit 24 is partially or completely torn, a supervising adult will know that the package has been handled. Cautionary steps can then be followed, for example, changing the storage location of the packages.

Figure 7:
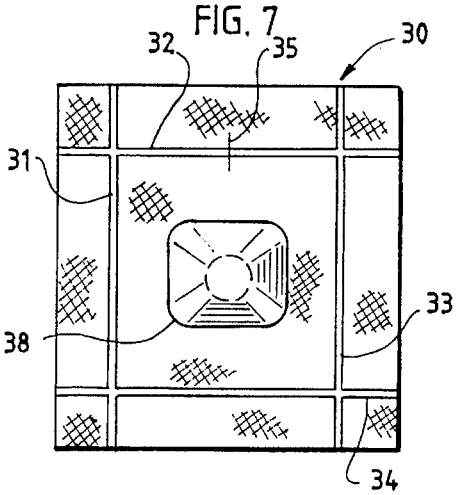
FIG. 7 is a plan view of another embodiment of a package formed in accordance with the invention.
Figure 8:
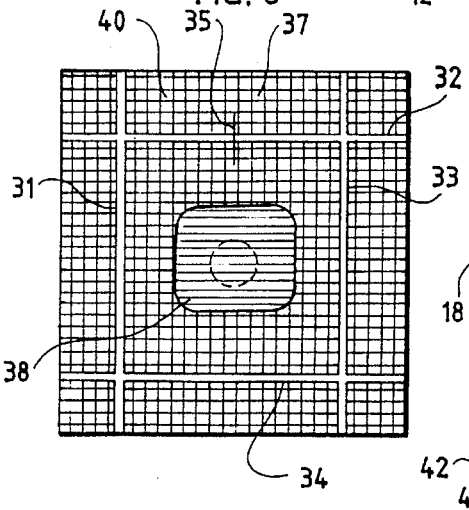
FIG. 8 is a diagramatic view of the package of FIG. 7 which illustrates the sealed and unsealed areas of the package.

FIGS. 7 and 8 illustrate an alternate embodiment of the invention. The package 30 is similar to the package 10 but includes four fold lines 31, 32, 33, and 34. A tear notch or slit 35 extends across only one of the fold lines, in this case the fold line 32. The fold line 32 is therefore the active fold line, and the other three fold lines are dummies or decoys which are intended to fool a child. The dummy fold lines 31, 33, and 34 have substantially the same appearance as the active fold line 32 except for the tear notch 35. The tear notch is visible to an adult who knows what to look for but is substantially unnoticeable by a child. The dummy fold lines can be made to look even more like the active fold line by imprinting the dummy fold lines with indicia that give the appearance of the tear notch 35.

If a child folds the package along one of the dummy fold lines, he cannot open the package. The child may lose interest in the package before he folds the package along the active fold line. A fold along one of the dummy fold lines provides evidence of tampering. If desired, only one or two dummy fold lines can be used instead of three.

Figure 4:
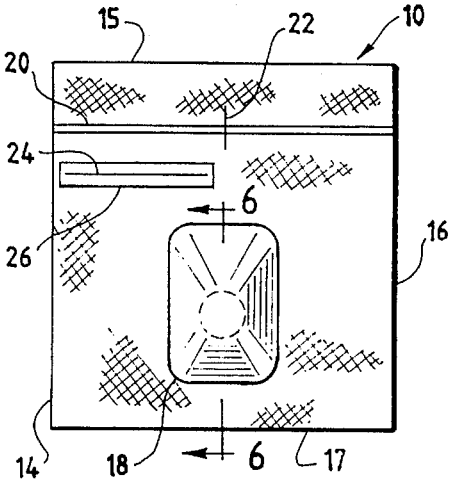
FIG. 4 is a plan view of the package.

The particular package 30 which is illustrated in the drawing does not include a slit for separating the tear notch 35 from the package. However, such a slit could be included if desired. Similarly, the package 10 illustrated in FIG. 4 could omit the slit 24 and unsealed area if desired.

FIG. 8 illustrates the sealed and unsealed areas of the package. The two layers of tear-resistant material are sealed together in the area 37 which is indicated by the horizontal and vertical cross hatching. An unsealed central pouch area 38 is indicated by horizontal cross hatching.

Figure 6:
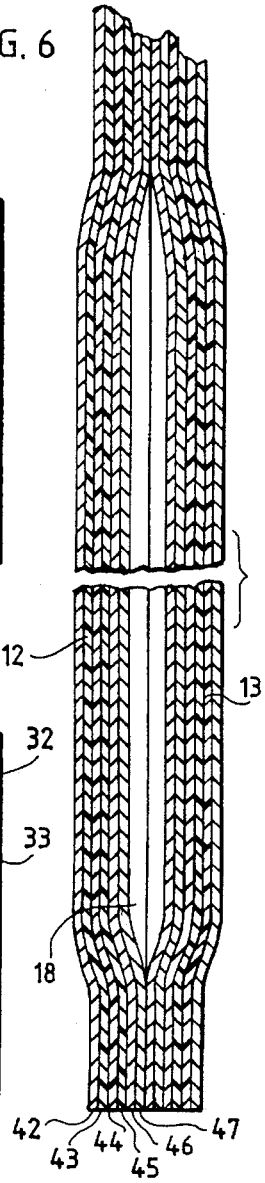
FIG. 6 is an enlarged fragmentary sectional view taken along the line 6—6 of FIG. 4.

Referring to FIG. 6, each of the tear-resistant layers 12 and 13 of the package is a laminate formed from a plurality of sheets. In the specific embodiment illustrated, each layer includes sheets of paper 42, low density polyethylene (LDPE) 43, polyethylene terephthalate (PET) 44, low density polyethylene 45, and metal foil 46 and a layer of heat seal adhesive 47. If desired, other means for securing the two layers together can be used. Examples of other suitable materials are described in U.S. Pat. No. 5,310,060, which is incorporated herein by reference.

The outer sheet of paper on each of the layers improves the aesthetics of the package and facilitates printing the package. If desired, the outer sheet can be plastic rather than paper. The first sheet of LDPE functions as an adhesive layer which bonds the outer sheet to the PET. The second sheet of LDPE bonds the PET to the metal foil. The sheet of PET strengthens the laminated layer and provides resistance against tearing. However, if the PET is cut, as at the slits 22, 24, and 35, a tear can be easily initiated at the cut. The sheet of metal foil provides a moisture barrier for the contents of the package.

The package can be produced on conventional pouch-making equipment in which one or two webs are advanced through multiple stations in the equipment. Each web consists of one of the laminated layers. If a single web is used, the web is folded to provide the two layers. At one station in the pouch-making equipment the two layers are heat sealed together by conventional heat seal dies. The unsealed area 26 can be formed by relieving the heat seal dies in those areas so that those areas are not contacted by the dies. The fold lines can be formed by the heat seal dies by providing a recess or channel in one die and a rib or projection on the other die which mates with the recess. The rib forces the two layers into the recess to form a U-shaped fold line. The fold lines can also be created at this final station.

As previously described, the slit 24 is preferably formed by slitting the webs before they are superimposed or even before they enter the pouch-making machine.

The tear notch 22 can be formed by a conventional die cut blade at another station in the pouch making equipment, or multiples thereof.

A later station in the pouch making equipment severs the two webs or layers to form individual packages.

Although two particular embodiments of the package of the invention have been shown and described herein, those of ordinary skill in the art will recognize numerous modifications and substitutions of that which has been described herein which may be made therein, as by adding, combining, or subdividing parts or steps, or substituting equivalents, while retaining significant advantages and benefits of the package of the invention, which itself is defined in the following claims. It is intended, therefore, that all of these modifications and variations be within the scope of the present invention as described and claimed herein, and that the invention be limited only by the scope of the claims which follow, and that such claims be interpreted as broadly as is reasonable.

Some of the unique features of the invention can be summarized as follows:

1. Inclusion of a fold or score line to assist in the accuracy and effectiveness of the opening procedure.
2. An extra wide heat seal area that contains the fold score with the tear notch, making it easy for the elderly or impaired to grasp and manipulate the heat seal area.
3. The potential for additional fold lines without a tear notch to distract and delay a child.
4. A tear strip or slit to attract the attention of a child for disarming the package.
5. Providing a slit in the pouch by means of pre-cutting during fabrication of the web material rather than on the package forming and filling equipment. An unsealed area surrounding the slit permits some tolerance in movement during registration of the front and back layers.

We claim:

1. A child-resistant package comprising first and second layers of tear-resistant material which are sealed together around an inner portion of each layer to provide an unsealed article-receiving pocket between the first and second layers, the first and second layers having a fold line and first means for permitting tearing of the layers on the fold line whereby said pocket can be opened by folding the first and second layers on said fold line and tearing said layers from the tearing means toward the pocket, and the first and second layers having a second tearing means which extends between the first tearing means and the pocket for permitting the first tearing means to be torn away from the portion of the package which contains the pocket.

2. The package of claim 1 in which the tearing means comprises a tear notch in said layers.

3. The package of claim 1 in which the second tearing means includes an unsealed area between the first and second layers.

4. The package of claim 3 in which the second tearing means further includes a slit in the first and second layers located within the unsealed area.

5. The package of claim 1 in which the first and second layers are heat sealed together.

6. The package of claim 1 in which each of the layers is a laminate which includes a sheet of metal foil.

7. The package of claim 1 in which each of the layers is a laminate which includes an outer sheet of paper or plastic and inner sheets of plastic and metal foil.

8. The package of claim 1 in which said first and second layers have a second fold line which is not provided with tearing means whereby if the first and second layers are folded on the second fold line the package cannot be torn to open the pocket.

9. The package of claim 1 in which the first and second layers include a substantial area which extends away from the pocket and the fold line is located in said substantial area.

10. A child-resistant package comprising first and second layers of tear-resistant material, each of the layers having a plurality of side edges, the layers being sealed together in an area extending inwardly from each of the side edges and being unsealed in a middle area of the layers to form an article-receiving pocket between the first and second layers, the first and second layers having a first fold line extending generally parallel to one of the side edges of the layers, the first and second layers having a tear notch which extends across the fold first line whereby said pocket can be opened by folding the first and second layers on said fold line and tearing said layers along said tear notch toward the pocket, and said first and second layers having a second fold line which extends generally parallel to another of the side edges of the layers, the second fold line not having a tear notch extending thereacross whereby if the first and second layers are folded on the second fold line the package cannot be torn to open the pocket.

11. The package of claim 10 including tear means in the first and second layers which extends between the tear notch and the pouch for permitting the tear notch to be torn away from the portion of the package which contains the pouch.

12. The package of claim 11 in which the tear means includes an unsealed area between the first and second layers.

13. The package of claim 12 in which the tear means further includes a slit in the first and second layers which is located within the unsealed area.

14. The package of claim 10 in which each of the layers is a laminate which includes a sheet of metal foil.

15. The package of claim 14 in which the first and second layers are heat sealed together.

16. The package of claim 10 in which each of the layers is a laminate which includes an outer sheet of paper and inner sheets of plastic and metal foil.

17. The package of claim 16 in which each of the layers is a laminate which includes an outer sheet of paper and inner sheets of plastic and metal foil.

18. A child-resistant package comprising first and second layers of tear-resistant material which are sealed together around an inner portion of each layer to provide an unsealed article-receiving pocket between the first and second layers, the first and second layers having a fold line and means for permitting tearing of the layers on the fold line whereby said pocket can be opened by folding the first and second layers on said fold line and tearing said layers from the tearing means toward the pocket, and said first and second layers having a second fold line which is not provided with tearing means whereby if the first and second layers are folded on the second fold line the package cannot be torn to open the pocket.

19. A child-resistant package comprising first and second layers of tear-resistant material, each of the layers having a plurality of side edges, the layers being sealed together in an area extending inwardly from each of the side edges and being unsealed in a middle area of the layers to form an article-receiving pocket between the first and second layers, the first and second layers having a fold line extending generally parallel to one of the side edges of the layers, the first and second layers having a tear notch which extends across the fold line whereby said pocket can be opened by folding the first and second layers on said fold line and tearing said layers along said tear notch toward the pocket, and tear means in the first and second layers which extends between the tear notch and the pouch for permitting the tear notch to be torn away from the portion of the package which contains the pouch.

* * * * *